United States Patent [19]

Jack

[11] Patent Number: 4,966,485

[45] **Date of Patent: * Oct. 30, 1990**

[54] SLIDING CLAMP FOR A BINDER HAVING FLEXIBLE BINDING PRONGS

[76] Inventor: Alister Jack, Patrijs 32, 9843 GS Grijpskerk, Netherlands

[ * ] Notice: The portion of the term of this patent subsequent to Apr. 30, 2004 has been disclaimed.

[21] Appl. No.: 752,028

[22] Filed: Jul. 5, 1985

[30] Foreign Application Priority Data

Dec. 31, 1982 [NL] Netherlands ..... 8205080

[51] Int. Cl.[5] ..... B42F 13/10; B42F 13/38

[52] U.S. Cl. ..... 402/16; 402/15

[58] Field of Search ..... 402/4, 5, 16, 17, 21, 402/23, 26, 28, 60, 64, 65, 68, 14, 15

[56] References Cited

U.S. PATENT DOCUMENTS

| | | | |
|---|---|---|---|
| 3,080,562 | 3/1963 | Potts et al. | 402/78 X |
| 3,285,250 | 11/1966 | Ivory et al. | 402/16 |
| 3,746,457 | 7/1973 | Comenitz | 402/16 |
| 4,304,499 | 12/1981 | Purcocks | 402/15 |

OTHER PUBLICATIONS

Red Rope Industries, Inc. (RRI), (Bristol, Penn.), *Data Processing Supplies, Featuring New Exclusive Data.Lok Binders,* Catalog No. EDP-72, undated, filed in U.S. PTO in 10/1972.

*Primary Examiner*—Robert L. Spruill
*Assistant Examiner*—Taylor J. Ross
*Attorney, Agent, or Firm*—B. Deon Criddle

[57] ABSTRACT

A sliding clamp for fastening the binding prongs of a binder having flexible binding prongs, which is adapted to slide in a rail-shaped member of substantially U-shaped cross-section, which is fitted with openings for the passage of the binding prongs, wherein the sliding clamp comprises a first elongate portion adapted to slide in the rail-shaped member and which is provided with a passage for a binding prong; and a second portion pivotally connected to the first portion, the second portion being adapted for pivotal movement in a pivoting line extending transversely to the longitudinal direction of the first portion, and that there are provided cam means for being locked in a position wherein the binding prong is bent and clamped.

7 Claims, 1 Drawing Sheet

SLIDING CLAMP FOR A BINDER HAVING FLEXIBLE BINDING PRONGS

The invention relates to a sliding clamp for fastening the binding prongs of a binder having flexible binding prongs, which is adapted to slide in a rail-shaped member of substantially U-shaped cross-section, provided with openings for the passage of the binding prongs.

Such a sliding clamp is known from U.S. Pat. No. 3,080,562. The known binder comprises an approximately U-shaped rail having two parallel legs linking up with a bottom portion, said legs being inwardly bent at the free edges. The bottom portion contains openings at an interspace corresponding with the distance between the flexible binding prongs, so that the prongs can extend through said bores. Besides, at least one sliding clamp is provided that is adapted to slide between the legs of the U-shape and which is fitted with a slot at the end facing the bottom of the U-shaped rail. When inserting the sliding clamp, this butts against a binding prong, which is thereby pushed against the bottom of the U-shaped rail and which, upon subsequent sliding movement, is received in the slot.

A drawback going with the prior art sliding clamp is that it can be easily pulled out of the rail unintentionally. In the past, this drawback was eliminated by providing the sliding clamp adjacent the front portion of the slot with a shorter slot closed at the front by an intermediate piece. The binding prongs can now extend both through the openings in he rail and through the slot in the sliding clamp, while the intermediate piece at the front end of the sliding clamp prevents the same from being pushed out of the rail entirely.

A drawback going with these two sliding clamps described is that when they are installed, the binding prong has to be bent by a force acting just beside a supporting point of the prong, viz. the edge of the opening in the rail. The bending of the prongs thus takes place heavily and with the risk that material is stripped off the prongs, so that the prongs are weakened and may break eventually, resulting in seizure of the sliding clamp.

Another drawback of the prior art sliding clamps is that these should be capable of sliding lightly in the rail, since it is always necessary for releasing the binding prongs to displace the sliding clamp so that, when the rail has been removed entirely from the prongs, the sliding clamps may fall out of the rail and get lost.

It is an object of the invention to eliminate the above drawbacks. To this end according to the invention, a sliding clamp of the above described type is characterized in that the sliding clamp comprises a first elongate portion adapted to slide in the rail-shaped member and which is fitted with a passage for a binding prong; and a second portion pivotally connected to the first portion, said second portion being adapted for pivotal movement in a pivoting line extending transversely to the longitudinal direction of the first portion, and which is provided with cam means for being locked in a position wherein the binding prong is bent and clamped.

One embodiment according to the invention will now be described, by way of example, with reference to the accompanying drawing, in which.

Figure 1:
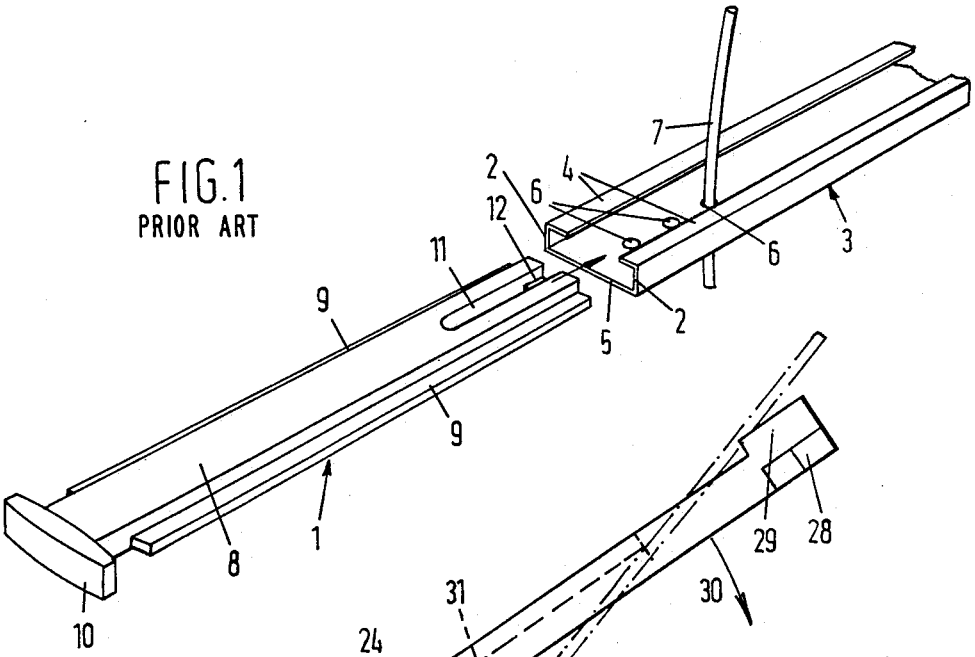
FIG.1 PRIOR ART
FIG. 1 shows a prior art sliding clamp with the associated rail and a binding prong extending through an opening in the rail.

FIG. 1 shows a prior art sliding clamp 1 adapted to slide between the flanges 2 of a rail-shaped member 3. The rail-shaped member has an approximately U-shaped cross-section, while the upright legs of the U-shape each have an inwardly bent flange 4. The bottom 5 of the U-shape contains a plurality of openings, one of which is shown at 6, through which a flexible binding prong 7 can be inserted.

The sliding clamp itself has an elongate, substantially rectangular body 8 adapted to slide with lateral flanges 9 just in the rail-shaped member 3.

The body 8 is designed in such a manner that in the operating condition a binding prong can lie in a space provided between the bottom of the rail-shaped member 3 and the underside of the body 8. The prong is then bent through about 90° in the place where the prong extends through the opening in the bottom of the rail-shaped member.

At the end of the sliding clamp turned outwardly in the operating condition, there is formed a thickened portion 10, serving as a stop, as a handle and as a suspension member for the binder.

At the other end of the sliding clamp, there is provided a slot 11 in registry with the position of the binding prong, said slot being shut off at the front by an intermediate piece 12. In the operating condition, said intermediate piece is located beyond the binding prong and the prong extends partly through the slot 11 over the intermediate piece. Therefore, the sliding clamp cannot be pulled out of the rail without anything more, even if the slot 11 is present above the opening 6.

Figure 2:
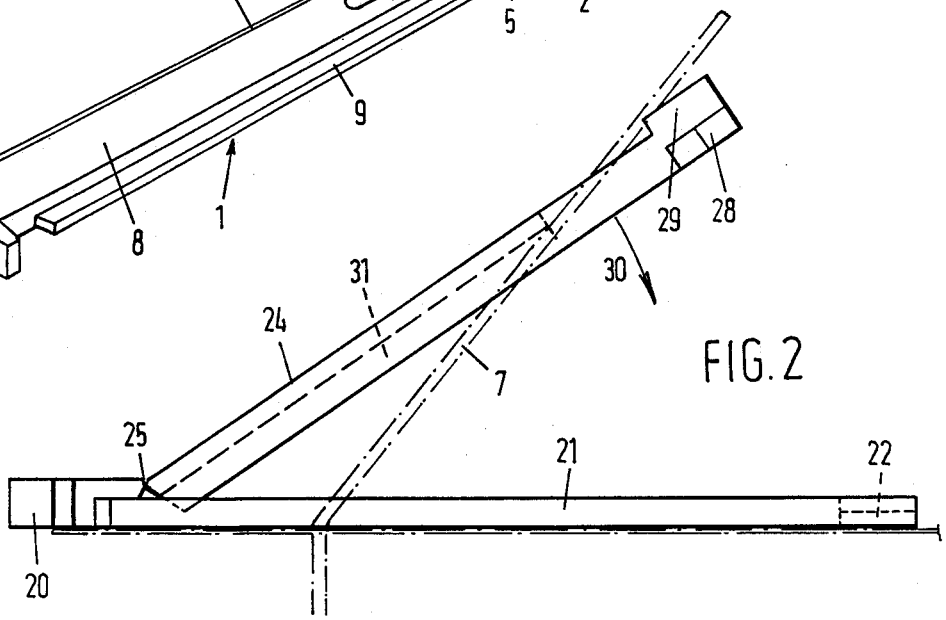
FIG. 2 is a side view of an embodiment of a sliding clamp according to the invention.
Figure 3:
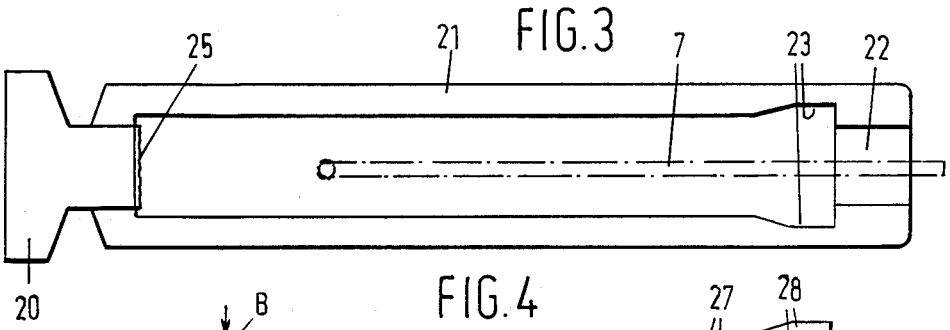
FIGS. 3 and 4 are top views of portions of the sliding clamp shown in FIG. 2.
Figure 4:
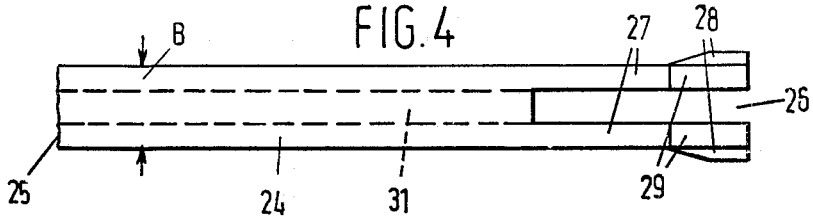

FIGS. 2–4 show an embodiment of a sliding clamp according to the invention. Said sliding clamp again comprises a stop 20, likewise functioning as a handle and as a suspension member.

From the stop there extends an elongate, frame-like portion 21 whose longitudinal ribs are adapted to slide just between the flanges 2 and underneath the flanges 4 of a rail-shaped member as shown in FIG. 1. The frame-shaped portion is shut off at the stop-averted end by a slightly thinner portion 22, over which lies the binding prong 7 in the operating condition indicated by broken lines in FIGS. 2 and 3. Furthermore, a recess 23 is formed in the longitudinal ribs of the frame-shaped portion on the inside, linking up, with the thinner portion 22, said recess, in the operating condition, extending underneath the flanges 4 of the rail-shaped member.

Besides, the stop 20 is pivotally connected at 25 to an elongate body 24. In FIG. 3, said elongate body has been omitted for the sake of clarity, but in FIG. 4 it is shown separately. Nevertheless, the elongate body preferably is integral with the frame-shaped portion, which can be realized in a simple manner with a synthetic plastics design. The pivoting line indicated at 25 can be formed by reducing the thickness of the material locally.

The width B of the elongate body is such that it fits between the longitudinal ribs of the frame-shaped portion.

The elongate portion is provided at the stop-averted end with a slot 26, thereby forming two legs 27 that are slightly resilient. At the free ends of the legs 27, there are formed laterally projecting cams 28, which correspond with the recesses 23 in the ribs of the frame-shaped portion.

Moreover, two projections 29 are formed at the top of the resilient legs 27 by means of which the gas can be manually pinched slightly towards each other.

When the sliding clamp has now been sliding the rail-shaped member in such a position that a binding prong extends through the frame-shaped portion, while the pivoting elongate member 24 is directed obliquely upwardly, as shown in FIG. 2, the binding prong can be clamped by folding down the elongate member 24, as indicated by an arrow 30 in FIG. 2. The legs 27 are then manually pinched slightly towards each other by means of the projections 29, so that the cams 28 can pass the flanges 4 and fall in the recesses 23.

The binding prong is then gradually bent at a force exerted at a considerable distance from the rail-shaped member, thus minimizing wear and facilitating the operation.

The elongate pivoting portion 24 is also provided with a slot 31 disposed, in operation, at the end facing the rail-shaped member, said slot extending into the extension of the slot 26 and being adapted to receive the binding prong in operating condition. The pivoting elongate portion enables to release or to fasten the binding prongs without the necessity of displacing the sliding clamp. As a result, it is only rarely necessary to displace the sliding clamp according to the invention, so that the frame-shaped portion can be dimensioned conveniently in such a manner that it slides heavily in the rail-shaped member. This has the advantage that even when the rail-shaped member has been entirely removed with the sliding clamp(s) from the binding prongs, the sliding clamp cannot fall out of the rail-shaped member and get lost.

It is observed that various modifications of the embodiment described are obvious to one skilled in the art after the foregoing. For instance, when the sliding clamp is actually so dimensioned that it heavily slides in the rail-shaped member, the intermediate piece 22 may be omitted. Such modifications are deemed to fall within the scope of the invention.

I claim:

1. A sliding clamp for fastening a binding prong of a binder having flexible binding prongs, which is adapted to slide in a rail shaped member of substantially C-shaped cross-section, which is fitted with openings for the passage of the binding prongs, characterized in that the sliding clamp comprises a first elongate portion adapted to slide in the rail-shaped member and which is provided with a passage for a binding prong; and a second portion pivotally connected to the first portion and forming an extension of said first portion, said second portion being adapted for pivotal movement in a pivoting line extending transversely to the longitudinal direction of the first portion, and having cam means for being selectively locked in a position within said rail shaped member wherein the binding prong is bent and clamped.

2. A sliding clamp according to claim 1, characterized in that the second portion is fitted at the bottom with a slot (31) perpendicular to the pivoting line (25) for receiving the binding prong in the clamping condition.

3. A sliding clamp according to claim 1, characterized in that the first portion has a member (20) extending, in operation, outside the rail-shaped member and a frame-shaped portion (21) having two longitudinal ribs extending from said member, and that the second portion (24) is pivotally attached to the member (20) and fits, in the operating condition, between the longitudinal ribs of the frame-shaped portion.

4. A sliding clamp according to claim 3, characterized in that a transverse rib (22) is disposed at the end of the frame-shaped portion (21) averted from the member (20), the transverse rib being at least partly thinner than the longitudinal ribs for forming a berth for the binding prong.

5. A sliding clamp according to claim 3, characterized in that the second portion is fitted at the free end with a slot (26) extending in the longitudinal direction of the second portion, said slot being defined on either side by resilient legs (29) carrying the cam means.

6. A sliding clamp according to claim 5, characterized in that the cam means comprise cams (28) extending laterally outwardly at the ends of the resilient legs (27), and that the longitudinal ribs of the frame-shaped portion are fitted at the facing ends with recesses (23) for receiving the cams (28).

7. A sliding clamp according to claim 6, characterized in that the resilient legs (27) each carry at the top a projection (29), so that the resilient legs can be pinched manually towards each other.

* * * * *